United States Patent [19]

Wedler

[11] Patent Number: 4,611,707

[45] Date of Patent: Sep. 16, 1986

[54] DEVICE FOR TRANSFERRING A BALL FROM A WINDING MANDREL TO A CARRIER MEMBER ARRANGED ON A CONVEYOR BELT

[75] Inventor: Klaus Wedler, Mittelbiberach, Fed. Rep. of Germany

[73] Assignee: Croon & Lucke Maschinenfabrik GmbH & Co. KG, Mengen, Fed. Rep. of Germany

[21] Appl. No.: 701,541

[22] Filed: Feb. 14, 1985

[30] Foreign Application Priority Data

Feb. 24, 1984 [DE] Fed. Rep. of Germany ..... 3406636

[51] Int. Cl.[4] ..... B65G 25/04

[52] U.S. Cl. ..... 198/468.2; 198/803.12; 242/2; 242/53; 57/266

[58] Field of Search ..... 242/2, 53; 57/266; 198/468.2, 486.1, 487.1, 803.12

[56] References Cited

U.S. PATENT DOCUMENTS 3,762,661 10/1973 Lucke ..... 242/53 X 4,003,524 1/1977 Taylor et al. ..... 242/53 X 4,176,802 12/1979 Lucke ..... 242/2

4,502,589 3/1985 Fichtner ..... 198/468.2

*Primary Examiner*—Joseph E. Valenza

*Assistant Examiner*—Michael Stone

*Attorney, Agent, or Firm*—Leydig, Voit & Mayer, Ltd.

[57] ABSTRACT

The disclosure describes a device for transferring a ball, skein or package from a winding mandrel to a freely projecting carrier arm mounted on a conveyor belt. This purpose is served by a wedge member, onto which the wound ball is moved by a gripping device and which subsequently moves with the ball towards the carrier arm. The wedge member and carrier arm both have a cross sectional profile which enables the wedge member to be displaced lengthwise of the carrier arm so as to pass over and beyond it and so the ball is pushed onto and remains on the carrier arm. In this way, the ball is exactly positioned and an arrow label may be inserted into the center hole of the ball with the aid of the carrier arm. Once the label has been inserted the labelled ball is withdrawn from the carrier arm.

4 Claims, 19 Drawing Figures

DEVICE FOR TRANSFERRING A BALL FROM A WINDING MANDREL TO A CARRIER MEMBER ARRANGED ON A CONVEYOR BELT

The invention relates to a device for transferring a ball, skein or package from a winding mandrel to a carrier member arranged on a conveyor belt, comprising a gripping device displaceable between winding mandrel and carrier member, this gripping device withdrawing the ball from the winding mandrel and conveying it to the carrier member.

In a known device of this type (German patent specification No. 22 44 638), the carrier members arranged on the conveyor belt are designed as relatively broad, flat dishes in which the balls of yarn or the like are placed such that they do not have an exactly defined position. As a result, it is often difficult to carry out subsequent treatment or work, for which an exact positioning of the ball is important.

An example of such additional work requiring an exact positioning of the ball is the insertion of so-called "arrow labels" into the center hole of the ball with the aid of automatic labelling machines.

The object underlying the invention is to develop a device of the type in question further such that the ball, skein or package is exactly positioned by the carrier member and enables, in particular, an arrow label to be inserted into the center hole of the ball etc. This is accomplished by the characterizing features A to F of patent claim 1.

The following description of preferred embodiments of the invention serves to explain the invention in greater detail in conjunction with the attached drawings, in which FIGS. 1 to 5 are schematic side views of the device for transferring a ball from a winding mandrel to a carrier arm in various positions;

Figure 1:
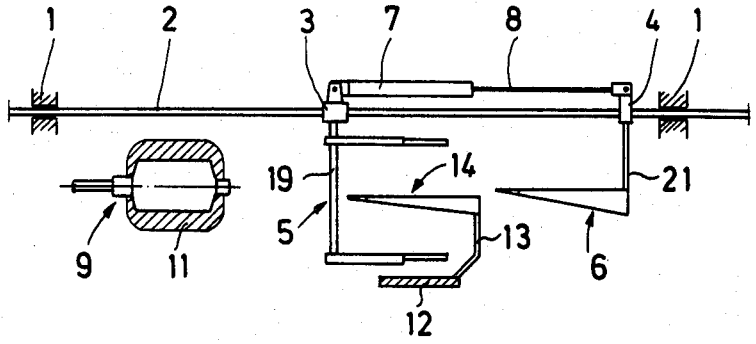

FIGS. 1 to 5 are schematic illustrations of a guideway 2 rigidly attached to a machine frame 1. A gripping device 5 and a wedge member 6 are disposed for sliding displacement along this guideway by means of a pair of sliding members 3, 4 and with the aid of a lever system which is known per se and therefore not illustrated. A pressure cylinder 7 is articulated with the sliding member 3 and its piston rod 8 is connected to the sliding member 4. If either the sliding member 3 or the sliding member 4 is held stationary on the guideway 2 and the pressure cylinder actuated, the wedge member 6 is displaced relative to the gripping device 5 or the gripping device 5 relative to the wedge member 6, as will be explained in the following.

A motor-operated winding mandrel 9 is rotatably mounted on the machine frame 1 in the known manner. A ball 11 of thread or yarn may be wound onto the winding mandrel, for example with the aid of a flyer which is not illustrated. Also mounted on the machine frame 1 is an endless conveyor belt 12 for transporting balls in a direction at right angles to the plane of drawing in FIGS. 1 to 5. A cantilevered carrier arm 14 is mounted on a support 13 projecting upwardly from the conveyor belt 12. The axes of the winding mandrel 9, carrier arm 14 and wedge member 6, in their illustrated operating positions, all lie in one and the same plane, namely the plane of drawing, whereby the carrier arm 14 is, of course, moved out of this plane when the conveyor belt 12 is actuated.

The winding mandrel 9 may be folded and unfolded in the known manner. FIG. 1 shows the mandrel in its unfolded state, in which the ball 11 is wound onto the mandrel.

Figure 2:
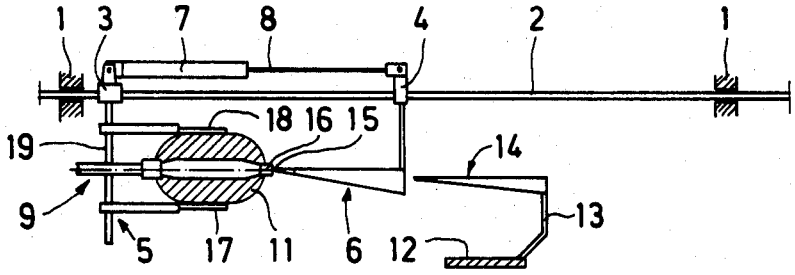

The device described operates as follows:

In FIG. 2, the mandrel 9 is folded together to facilitate withdrawal of the wound ball or package 11. The gripping device 5 has been moved along the rod 2 to the left together with the wedge member 6. The wedge member has already been moved over and beyond the stationary carrier arm 14 and is now positioned such that the tapering end 15 of the wedge member penetrates slightly into the tubular extension 16 of the winding mandrel 9 and is hereby centered. Two gripper members 17, 18 are now moved toward one another in the known manner along a rod 19 connected to the sliding member 3 such that they grip the ball 11 lightly between them and hold it firmly. The two gripper members 17, 18 may be moved toward one another with the aid of a device actuated by pressure fluid which is not illustrated. Subsequently, the sliding member 4 is held stationary on the rod 2 together with the wedge member 6 and the cylinder 7 is actuated by the introduction of pressure fluid. The sliding member 3 is then moved to the right and the ball 11 held between the gripper members 17, 18 is pushed onto the wedge member 6 (as shown in FIG. 3) with its center hole which was previously occupied by the winding mandrel 9.

Figure 3:
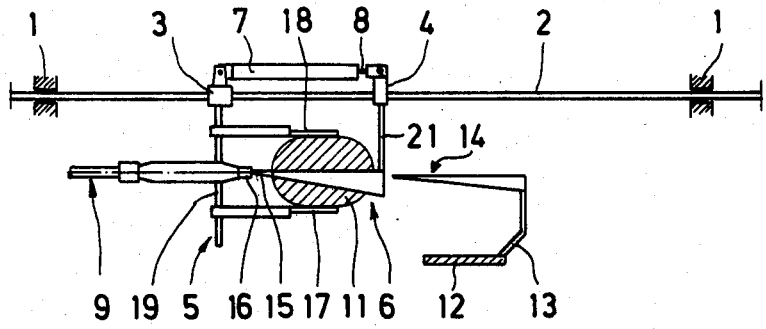
Figure 4:
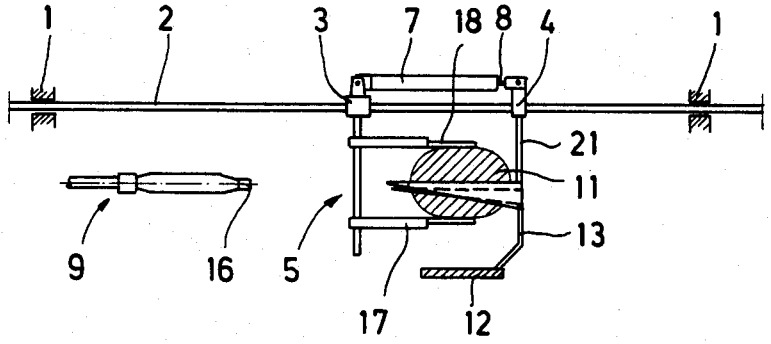

As shown in FIG. 4, the two sliding members 3, 4 are maintained in their positions relative to one another, as shown in FIG. 3, and moved together to the right. The ball 11 is thereby moved to the right as well. The wedge member 6 which now carries the ball 11 is pushed over the carrier arm 14 such that the latter is now positioned within the center hole of the ball 11 as well.

Figure 5:
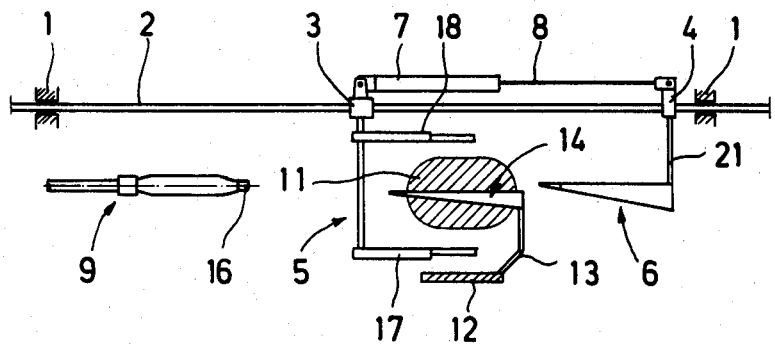
Figure 6:
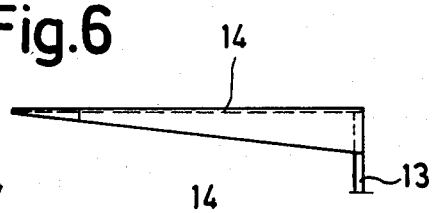
FIGS. 6 to 8 are various views of the carrier arm.
Figure 8:
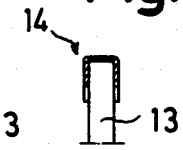
Figure 7:
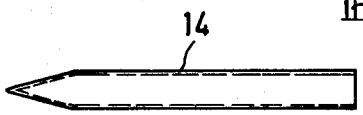
Figure 9:
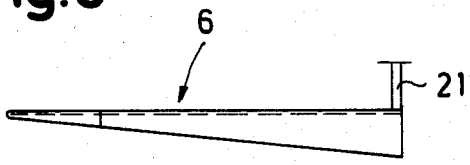
FIGS. 9 to 11 are various views of a wedge member for transferring the ball to the carrier arm.
Figure 11:
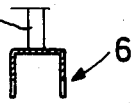
Figure 10:
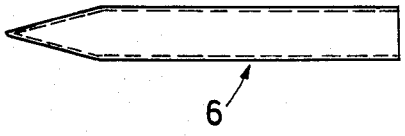
Figure 12:
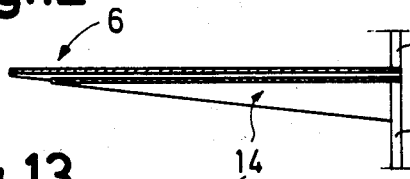
FIGS. 12 to 14 show the wedge member covering the carrier arm.
Figure 14:
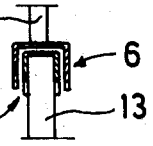
Figure 13:
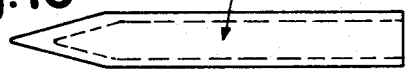

Finally, the sliding member 3 is held stationary and the pressure cylinder 7 again actuated so that the sliding member 4 connected to the piston rod 8 is displaced (to the right in FIG. 5). The wedge member 6 is hereby moved beyond the carrier arm 16 and withdrawn from the ball 11 which is prevented from moving with the wedge member 6 by the support 13. During this procedure, the two gripper members 17, 18 are detached from the ball 11, as also shown in FIG. 5. It is also possible for the gripper members 17, 18 not to be detached until the wedge member 6 has been withdrawn out of the ball 11. The gripping device 5, wedge member 6 and carrier arm 14 thereby return to their original positions illustrated in FIG. 1. When the conveyor belt 12 is actuated, the ball held on the carrier arm 14 can be transported away for further work. Once the carrier arm 14, or another carrier arm 14 connected with the conveyor belt 12, is again in the position shown in FIG. 1 and the winding mandrel 9 has again been unfolded, the procedure described above can be repeated.

Since the carrier arm 14 penetrates completely through the center hole of the ball 11, the ball 11 is held in an exactly defined position and can thus be fed to an automatic station for further work to be carried out, in particular a labelling station, at which it is important for the ball 11 to be in an exact position.

FIGS. 6 to 13 illustrate constructional developments of the carrier arm 14 and the wedge member 6. As shown, the wedge member 6 and the carrier arm 14 have a U-shaped cross section, the U-profile of each being downwardly open. The U-profile of the carrier arm 14 is secured to the support 13 projecting downwardly from the arm whereas the U-profile of the wedge member 6 is secured to a support 21 extending upwardly to connect with the sliding member 4. This enables the wedge member 6 to slide unhindered over the carrier arm 14 in the way described.

Both the wedge member 6 and the carrier arm 14 are tapered towards their ends facing the winding mandrel 9. This makes it easier for the ball 11 to be moved onto the wedge member 6 (FIG. 3) and for the rearward end of the wedge member 6 to pass over the carrier arm 14 (FIG. 4). As shown in particular in FIGS. 12 and 14, the wedge member 6 is mounted at a slightly higher level than the carrier arm 14 to enable these two parts to be moved easily over or under one another. As also shown by FIGS. 6 to 14, it is not only the respective upper sides of wedge member 6 and carrier arm 14 which are tapered but also their respective side faces which form the legs of the U-profile.

When the ball 11 is exactly positioned on the carrier arm 14 in the way shown in FIG. 5 and carried to a labelling station by the conveyor belt 12, the tapering end of the carrier arm 14 can be positioned exactly in front of a label feeder. Since the carrier arm 14, which may project beyond the ball 11 with its cantilevered end remote from the support 13, keeps the center hole of the ball 11 open and, if necessary, even enlarges it, it is possible for the label feeder to insert a so-called arrow label reliably and exactly into this center hole. Once the label has been inserted the ball 11 is withdrawn, together with the label, from the carrier arm 14 (to the left in FIG. 5) and, if required, pressed flat to form a so-called "flat ball or package". The ball may also be removed and pressed flat with the aid of simple automatic devices.

In any case, a method for inserting arrow labels or the like into the center hole of balls of yarn or thread can be performed in this way in accordance with the invention. The inventive method, as described, consists essentially in the fact that a carrier arm is inserted from one end of the ball into its center hole and keeps this center hole open, the arrow label is inserted into the center hole from the other end of the ball and the carrier arm is then withdrawn.

FIGS. 15 to 18 illustrate a carrier arm having the shape of a bill or beak 22 which is particularly suitable for the application of arrow labels to balls. The bill 22 consists of an upper half 24 and and a lower half 25. Each half has a U-shaped cross section (cf. FIG. 17) and tapers towards its free end. The upper half 24 partially embraces the lower half 25 which is mounted on a support 23 corresponding to the support 13 of carrier arm 14. The two halves of the bill 24, 25 are articulatedly connected with one another via an axis 26. A compression spring 27 arranged on the rearward end of the bill 22 between the halves 24, 25 normally holds the bill in the closed position shown in FIG. 15. If pressure is exerted on the rearward end of the bill 22 this opens at its cantilivered end and the two halves 24, 25 are then in the position shown in FIG. 18.

If the bill 22 is positioned in the center hole of a ball, as illustrated in FIG. 5 for the carrier arm, and is then opened, the center hole of the ball 11 will be opened and enlarged to a considerable degree in the region of the tip of the bill. This enables the arrow label to be inserted comfortably.

Figure 19:
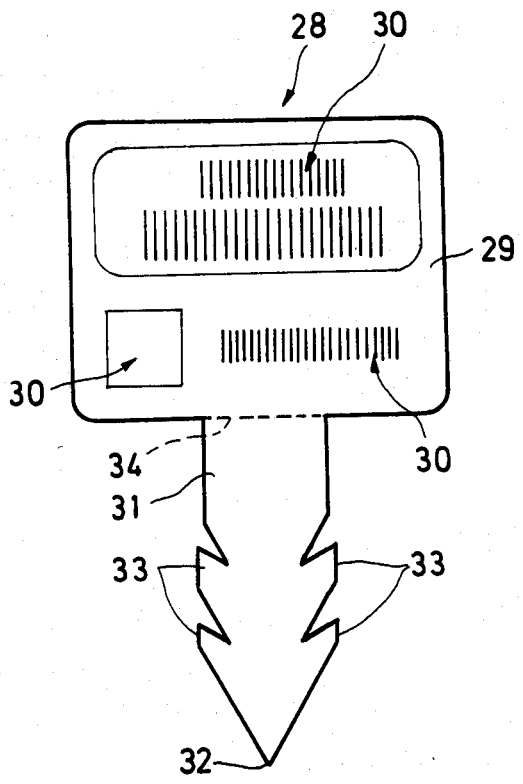
FIG. 19 shows an arrow label.

FIG. 19 shows an arrow label 28 of the type in question. It consists of a wide portion 29 with the usual imprint 30. The label portion 29 is connected to an arrow portion 31 having a tip 32 with barbs 33. The arrow label 28 is inserted into the center hole of the ball with its tip 32 first. The barbs 33 which catch in the innermost windings of the ball prevent the label being withdrawn out of the center hole of the ball. The portion 29 of the label may be folded along the broken line 34 at right angles relative to the arrow portion 31 so that it rests against one end face of the ball 11 which has, if necessary, been pressed flat.

It is usual for one and the same ball winding machine to have a plurality of winding stations, each with a winding mandrel 9 and a gripping device 5, arranged adjacent one another. In accordance with the invention, each winding station is provided with a wedge member 6 and a carrier arm 14, if required designed as a bill 22. In this way, it is possible to pass a prepared batch of, for example, 10 or 20 balls to a labelling station for labelling with arrow labels, whereby the individual balls run through the labelling station one after the other, while the next batch of balls is already being wound at the winding stations of the machine.

In the embodiment illustrated, the gripping device 5 and wedge member 6 are disposed for linear sliding displacement along a guideway (rod 2). In another embodiment of the invention, the gripping device and the wedge member 6 may be mounted for pivoting movement relative to the winding mandrel 9 and consequently move along a curved line.

Figure 15:
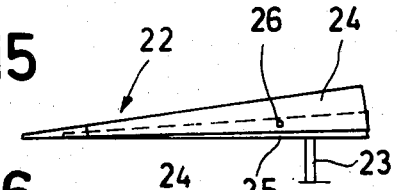
FIGS. 15 to 17 show a carrier arm designed as a bill.
Figure 17:
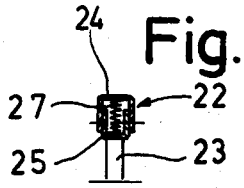
Figure 16:
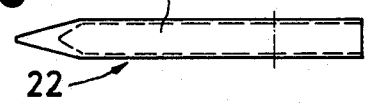
Figure 18:
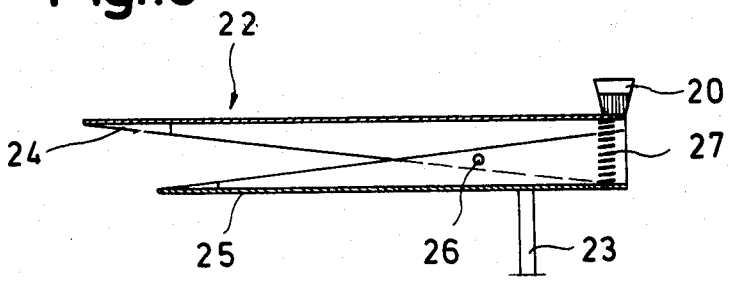
FIG. 18 shows the bill of FIG. 15 when opened.

The simplest way of opening the bill from its closed position shown in FIG. 15 to its open position shown in FIG. 18 is for the rearward end of the upper half 24 of the bill to engage on a stationary cam rail 20 when the conveyor belt 12 is moving. This cam rail is disposed parallel to the conveyor belt and presses the end of the upper half of the bill downwards so that the bill opens into the position shown in FIG. 18.

What is claimed is:

1. A device for transferring a ball from a winding mandrel to a carrier means arranged on a conveyor belt comprising:

a gripping means displaceable between the winding mandrel and the carrier means, said gripping means withdrawing the ball from the winding mandrel and conveying it to the carrier means;

the carrier means having a cantilevered carrier arm attached to the conveyor belt, said carrier arm fitting into a center hole of the ball;

a wedge means adapted to be positioned with its tapering end at the free end of the winding mandrel upon commencement of the ball withdrawal procedure;

the gripping means being displaceable relative to the wedge means and pushing the ball from the winding mandrel onto the wedge means;

means for moving said wedge means towards the carrier arm together with the gripping means and the ball;

the cross sectional profiles of the wedge means and the carrier arm being such that the wedge means is displaceable lengthwise of the carrier arm so as to pass over said arm; and means for displacing the wedge means beyond the carrier arm when the gripping means is stationary so that the ball is pushed onto and remains on the carrier arm.

2. A device as defined in claim 1 wherein the carrier arm and/or wedge means have a U-shaped cross section.

3. A device as defined in claim 1 wherein the carrier arm comprises a bill which serves to enlarge the center hole of the ball.

4. A device as defined in claim 2 wherein the carrier arm comprises a bill which serves to enlarge the center hole of the ball.

* * * * *